United States Patent [19]

Matsumoto

[11] Patent Number: 4,921,440

[45] Date of Patent: May 1, 1990

[54] CONNECTOR AGGREGATE

[75] Inventor: Masatsugu Matsumoto, Tokyo, Japan

[73] Assignee: Create System Co., Ltd., Tokyo, Japan

[21] Appl. No.: 291,742

[22] Filed: Dec. 29, 1988

[30] Foreign Application Priority Data

Mar. 12, 1988 [JP] Japan ..... 63-32874[U]

[51] Int. Cl.[5] ..... H01R 4/24

[52] U.S. Cl. ..... 439/421; 439/877; 439/885

[58] Field of Search ..... 439/421, 423, 424, 877–882, 439/885

[56] References Cited

U.S. PATENT DOCUMENTS

| | | | |
|---|---|---|---|
| 4,054,354 | 10/1977 | Unger | 439/885 |
| 4,082,402 | 4/1978 | Kinkard et al. | 439/877 |
| 4,565,418 | 1/1986 | Graeser, Jr. et al. | 439/423 |

*Primary Examiner*—Joseph H. McGlynn

*Attorney, Agent, or Firm*—Frishauf, Holtz, Goodman & Woodward

[57] ABSTRACT

A connector aggregate, comprising connectors each comprising a socket housing provided with a plurality of connecting sections fitted with a corresponding number of terminals; said connectors being linked in a belt-like fashion through linking pieces which are provided on both side portions of said socket housing and which linking pieces are readily separable from each other.

11 Claims, 7 Drawing Sheets

CONNECTOR AGGREGATE

FIELD OF THE INVENTION

The present invention relates to an aggregate of connectors each comprising a socket housing provided with a plurality of connecting sections and a corresponding number of terminals fitted to these connecting sections.

BACKGROUND OF THE INVENTION

Various types of connectors have hitherto been used to provide electrical connection between electric circuits or electrical equipment. In general, these connectors are comprised of an insulating socket housing that holds therein a terminal having a wire-connecting portion and a contact. In this instance, the contact includes a male contact and a female contact, which are engaged with each other to make an electrical connection.

Known terminals used in connectors as set out above are crimp terminals having a structure such that the wire-connecting portion crimps the core (bared portion) of a stripped wire, and insulation displacement terminals having a structure such that the wire-connecting portion makes an electrical connection by forcing the wire into a U-contact to out through its cover (or insulation) at that portion to make contact with the wire.

In recent years, in order to achieve electrical wiring with ease, widely employed are connectors such that a plurality of wires such as a ribbon cable and a flat cable are connected to one connector so that a plurality of electric circuits may be connected in a bundle. These connectors comprise a socket housing provided with a plurality of connecting sections, and terminals respectively fitted to these connecting sections.

These connectors are manufactured in a one-by-one separated state, and they are attached to wires in the manner that they are continuously fed one by one using a parts feeder. In such an instance, the parts feeder takes the structure that it arranges the direction of a number of connectors in line and successively delivers them to a wire processing apparatus such as an insulation displacement machine along a guide rail or the like.

However, such a parts feeder necessarily has a complicated and large-sized structure, and hence had the problem that it brings about a high cost for the wire processing apparatus as a whole. Moreover, misregistration or lifting tends to occur when connectors are fed, and also reject parts have been produced at a high rate because of wire misattachment. Furthermore, modification in size of connectors makes it necessary to change parts such as guides, resulting in a poor operability.

SUMMARY OF THE INVENTION

The present invention was made on account of the above problems involved in the prior art, and an object thereof is to provide a connector aggregate that can be conveniently handled and can be readily fed to a wire processing apparatus.

To achieve the above object, the present invention provides a connector aggregate, comprising connectors each comprising a socket housing provided with a plurality of connecting sections fitted with a corresponding number of terminals; said connectors being linked in a belt-like fashion through linking pieces which are provided on both side portions of said socket housing and readily separable from each other.

DESCRIPTION OF THE PREFERRED EMBODIMENTS

As mentioned above, the present invention comprises connectors being linked in a belt-like fashion through linking pieces which are provided on both side portions of said socket housing and readily separable from each other, and hence this belt-like article may be delivered as it is, in the longitudinal direction, so that it can be fed to a wire processing apparatus in the state that the direction of connectors has been arranged in a line. In the wire processing apparatus, wires are attached to the connectors being delivered, the linking pieces are cut off, end thus the operation to attach wires is completed. Accordingly, a connector-feeding apparatus may be satisfactory if it can deliver the aggregate of connectors linked in a belt-like fashion, to predetermined positions on the wire processing apparatus with a given pitch, so that its structure can be very simplified and the cost can be greatly reduced as compared with conventional parts feeders. Also, since the connectors can be precisely arranged in a line owing to the linking pieces, the rate of the reject parts production due to wire misattachment can be decreased. In addition, even if the size of the connectors to be used has been modified, simple parts such as guides adjacent to the wire processing apparatus may only be changed, resulting in improved operability.

Figure 6:
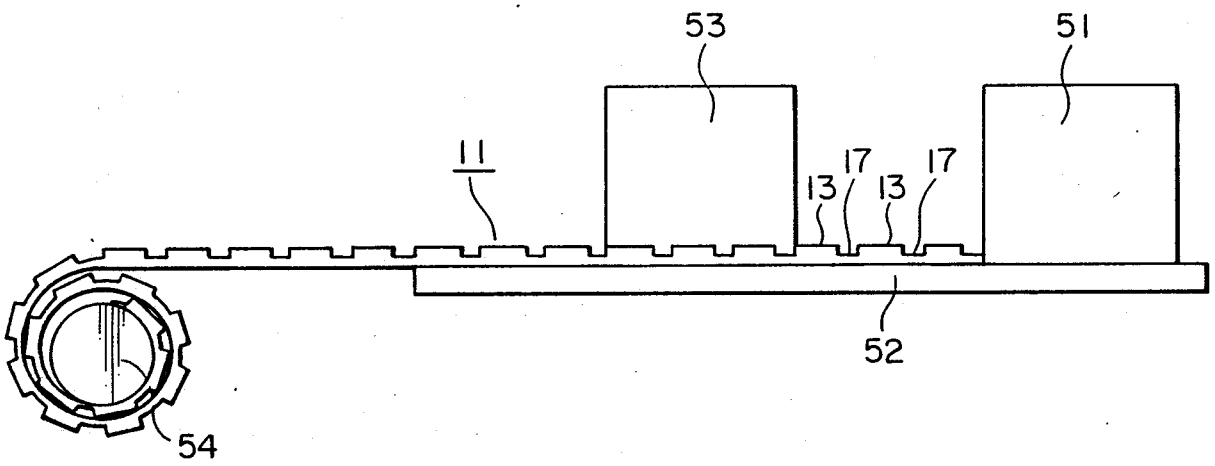
FIG. 6 is a schematic illustration of a process of preparing the connector aggregate.
Figure 7:
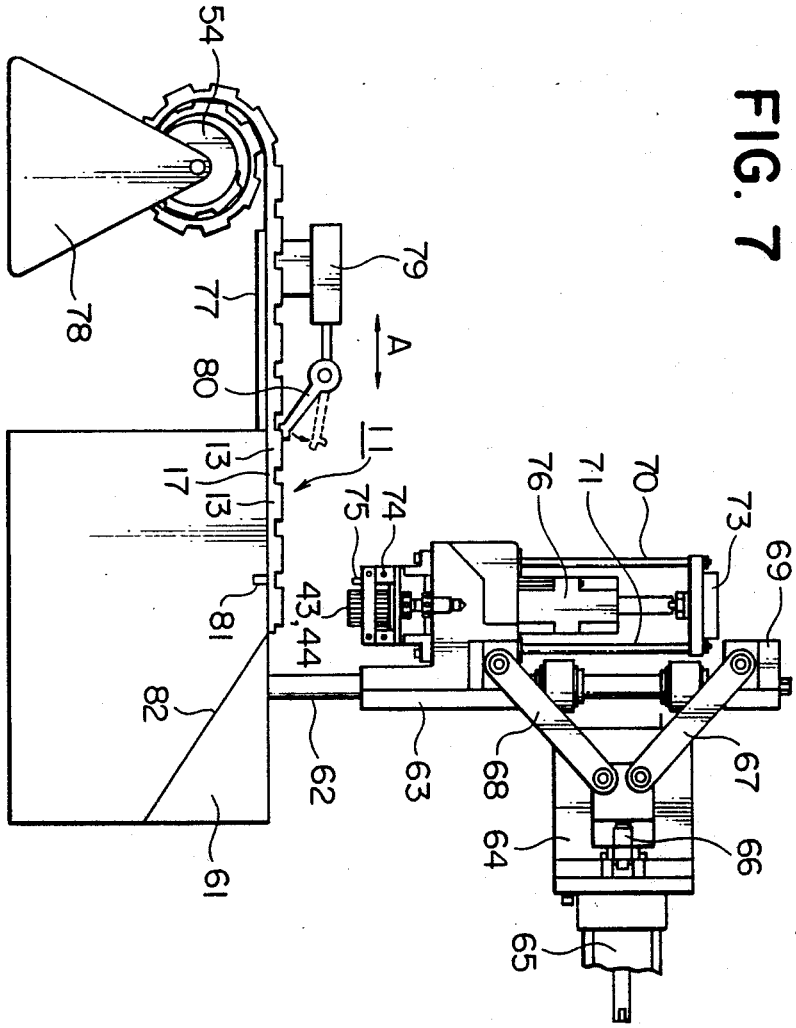
FIG. 7 is a front view to illustrate an apparatus for attachment of wires with use of the connector aggregate.

In a preferred embodiment of the present invention, the connectors linked in a belt-like fashion are Wound on a reel, as shown in FIGS. 6 and 7.

Accordingly, in the manufacture of the connectors, the belt-like connector aggregate being finished may be successively wound up on a reel. In the feeding of the connectors, the belt-like connector aggregate may be successively let out from the reel. In the changing of the connectors, they may be changed together with the reel. Thus, the operability can be further improved.

In the present invention, the terminal may comprise either crimp terminals or insulation displacement terminals. Usually insulation displacement terminals are used so that wires can be attached in the state where the terminals have already been mounted in a socket housing. However, as herein described below as an embodiment, even crimp terminals can take a structure such that wires are attached in the state where terminals have already been mounted in a socket housing.

FIG. 1 to FIG. 5 illustrate an embodiment of the connector aggregate according to the present invention.

Figure 1:
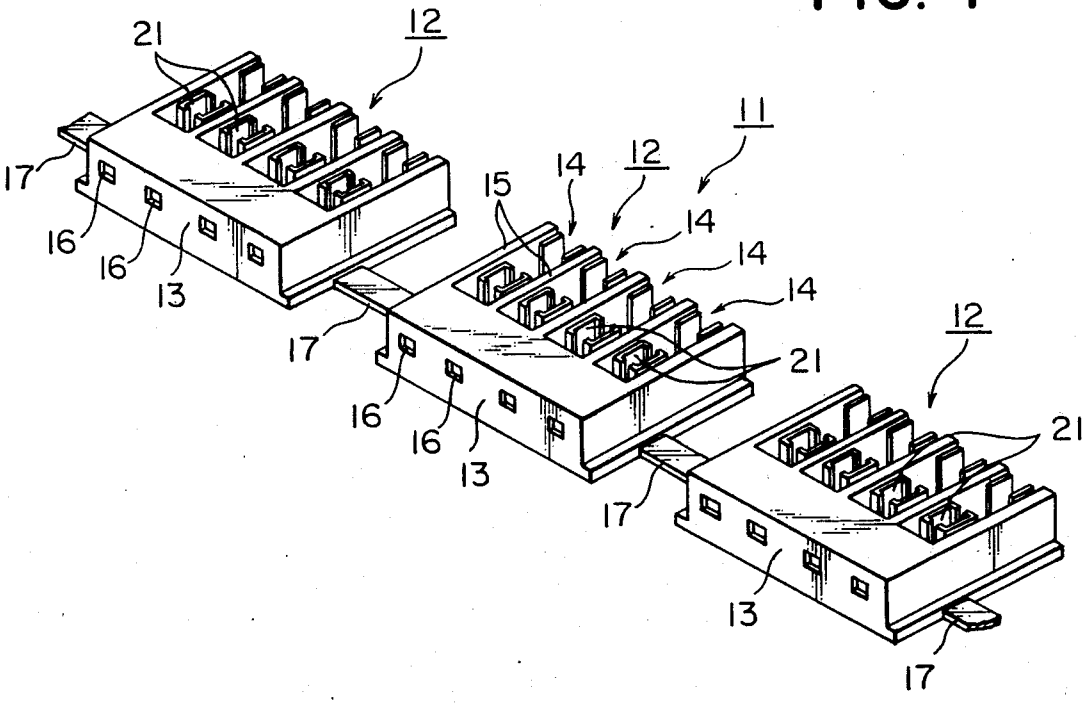
FIG. 1 is a perspective illustration of an embodiment of the connector aggregate according to the present invention.

As illustrated in FIG. 1, this connector aggregate denoted as 11 is comprised of a number of connectors 12 laterally linked in a belt-like fashion. Each connector 12 comprises a socket housing 13, and the socket housing 13 comprises four connecting sections in the case of this embodiment. Each connecting section 14 is partitioned with partition walls 15 on its both sides. Openings 16 through which contacts are inserted are formed in the front end face of the socket housing 13. Then, both side portions of this socket housing 13 are laterally linked to each other through a sheet-like linking piece 17, thus forming a connector aggregate 11 comprising connectors linked in a belt-like fashion as a whole. The linking piece 17 may be satisfactory if it can be readily cut off, and may otherwise comprise a thin rod-like linking piece, or may comprise two linking pieces. As described below, it is preferable that the linking pieces be bendable to a certain extent when wound up on a reel. These linking pieces 17 are integrally formed with resin when the socket housings 13 are molded.

Figure 2:
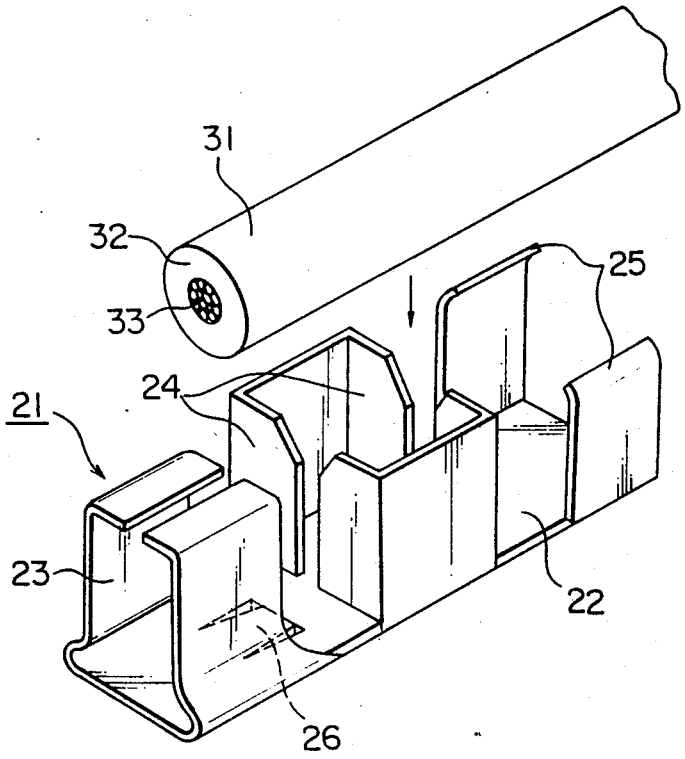
FIG. 2 is a perspective illustration of an insulation displacement terminal used in the connector aggregate.

In the case of this embodiment, each connecting section 14 of the socket housing 13 is fitted with an insulation displacement terminal 21. The insulation displacement terminal 21 comprises, as illustrated in FIG. 2, a female contact 23 formed at the front end of a bottom wall 22, two sets of U-contacts 24 formed at the middle of the bottom wall 22, and a pair of wire-holding claws 25 formed at the rear end of the bottom wall 22. The female contact 23 may alternatively be a male contact having a pin projected forward. Also, the U-contact 24 comprises as known in the art, a pair of blades opposingly disposed with a given space. When the wire 31 is forced into the U-contact these blades cut through a cover 32 of the wire 31 and comes into contact with a core 33, thus making a conductive connection between them. The wire-holding claw 25 is inward crimped with a crimper described below to hold the wire 31. Also, a hook 26 formed by a U-form cut is provided in the bottom wall 22 at a portion near to the front. The hook 26 is connected at its front portion to the bottom wall 22, and its rear portion projects from the bottom wall 22, obliquely downward in the shape of a tongue.

Figure 3:
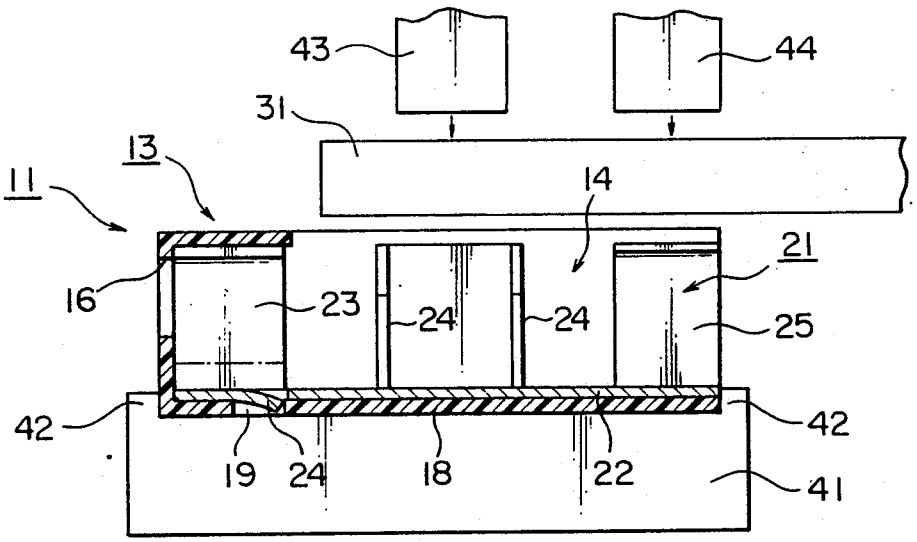
FIG. 3 is a cross section of a connector which is a part of the connector aggregate

The socket housing 13 is fitted with this insulation displacement terminal 21 in the manner as illustrated in FIG. 3. More specifically, an opening 19 is formed at a portion near to the front of the bottom wall 18 of the socket housing 13, and, when the insulation displacement terminal 21 is inserted into the connecting section 14 of the socket housing 13, the hook 26 of the insulation displacement terminal 21 engages with the opening 19 to prevent dislocation. In this instance, the insulation displacement terminal 21 is inserted, with the bottom wall down and the contact 23 frontward, into the socket housing 13 from its upper and rear openings. The structure with which the insulation displacement terminal 21 and the socket housing 13 are assembled may not be limited to the structure as described above, and there can be employed various structures as exemplified by the structure in which a protuberance formed in the bottom wall of the socket housing 13 is engaged with an opening formed in the bottom wall 22 of the insulation displacement terminal 21, and the structure in which the insulation displacement terminal 21 and socket housing 13 are integrally formed.

When the wire 31 is attached, the connector 11 is placed on a pedestal support 41 of an insulation displacement machine, with registration by guides 42 and 42, and an end of the wire 31 is disposed above the corresponding connecting section 14 of the connector 11. Then, an insulation displacement tooth 43 and crimper 44 of the insulation displacement machine force down the wire 31, where the insulation displacement tooth 43 forces the wire 31 into the two sets of U-contacts 24, and the crimper 44 inward crimps the wire-holding claw 25 to hold the wire 31.

Figure 4:
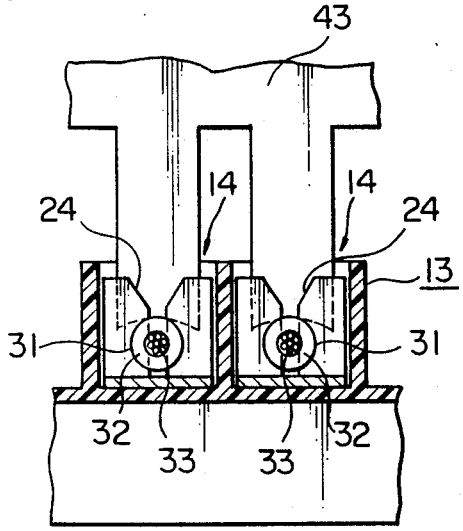
FIG. 4 is a cross section of the part at which a wire has been brought into insulation displacement at a U-contact in the insulation displacement connector.

FIG. 4 illustrates how the insulation displacement tooth 43 has been forced down against the wire 31. The insulation displacement tooth 43 comprises a plurality of teeth respectively inserted into the corresponding connecting sections 14, and the teeth each have the shape of a concave arc on their bottom surfaces. Then the insulation displacement tooth 43 forces the wire 31 into the space defined by each U-contact 24, so that both blades of the U-contact cut through the cover 32 of the wire 31 and come into contact with a core 33, thus making a conductive connection between them.

Figure 5:
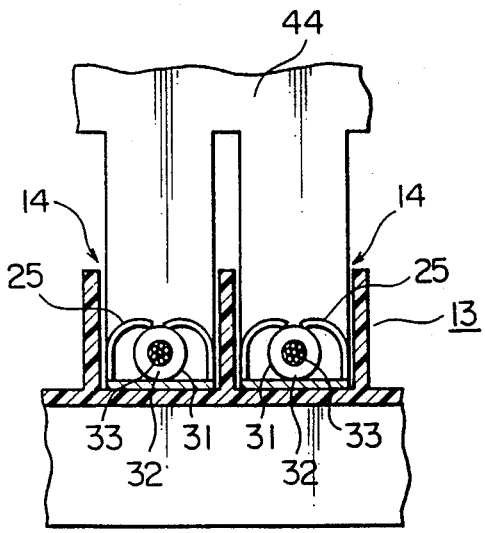
FIG. 5 is a cross section of the part at which a pair of wire-holding claws has secured the wire in the insulation displacement connector.

FIG. 5 also illustrates ho the crimper 44 has been forced into sections 14. The crimper 44 comprises a plurality of teeth respectively inserted into the corresponding connecting sections 14, and the teeth each have the shape like double-linked concave arcs on their bottom surfaces. Once the crimper 44 is brought down, the wire 31 is inserted between the wire-holding claws 25, and the wire-holding claws 25 are inward crimped to hold the wire 31.

FIG. 6 illustrates a process of preparing the connector aggregate 11 according to the present invention. Using a known continuous molding machine 51, the socket housings 13 are molded in the state that they are linked with the linking pieces 17, and fed out in a belt-like fashion. This belt-like article is moved on a table 52 and led into a known terminal-inserting unit 53, where the above insulation displacement terminals 21, for example, are inserted into the respective connecting sections 14 of the socket housings 13. The belt-like connector aggregate 11 thus prepared is wound up on a reel 54.

FIG. 7 illustrates an apparatus for attaching ends of wires to the connectors using the connector aggregate 11 according to the present invention.

On an upstanding pedestal 61, a guide rod 62 is provided, and a movable block 63 is mounted on this guide rod 62 in an upward-downward movable state. An air cylinder 65 is fitted to the upper back side of the guide rod 62 via a support plate 64, and ends of links 67 and 68 are pivotably secured cured to an end of a piston rod 66 of the air cylinder 65. The links 67 and 68 extend apart in a Y-form, whereas the other end of the link 67 is pivotably secured to a stationary plato 69 fitted to the upper end of the guide rod 62, and the other end of the link 68 is pivotably secured to the movable block 63. Hence, the movable block 63 is so designed as to be upward-downward moved by the actuation of the air cylinder 65. The movable block 63 is fitted at its bottom part with the insulation displacement tooth 43 and crimper 44 described above. Also, guide rods 70 and 71 are upward-downward slidably inserted into the movable block 63, and top ends of the guide rods 70 and 71 are connected with a connecting member 73. Lower ends of the guide rods 70 and 71 are connected with a connecting member 74. Also, the lower connecting member 74 is fitted with a cutter 75. An air cylinder 76 is further set on the movable block 63, and an operating rod thereof is joined to the upper connecting member 73, where the guide rods 70 and 7 upward-downward slide by the actuation of the air cylinder 76, so that the cutter 75 may further upward-downward move with respect to the movable block 63.

A guide 77 is provided so as to extend to the side of the pedestal 61, and the belt-like connector aggregate 11 is let out from the above-mentioned reel 54 supported on a pedestal support 78 so that it may be fed through the guide 77 to the insulation displacement position on the pedestal 61. The connector aggregate 11 is delivered by a pusher 80 that reciprocates as shown by arrow A in FIG. 7 by the action of an air cylinder 79. The pusher 80 is vertically swingingly secured to an operating rod of the air cylinder 79 through a ratchet. When the connector aggregate 11 is moved to the right direction viewed in the drawing, the pusher 80 is engaged with the socket housing 13 at its edge to deliver the connector aggregate 11, and when moved to the left direction viewed in the drawing, it is so designed as to swing away as shown by the imaginary line in FIG. 7. The pedestal 61 is provided thereon with a groove 81 into which the cutter 75 comes, and a chute 82 to collect connectors to which wires have been attached.

Therefore the belt-like connector aggregate 11 is intermittently pushed forward by the pusher 80, and fed to the predetermined position on the pedestal 61 through the guide 77. When a connecter taking the lead in the connector aggregate 11 is disposed to the predetermined position, the air cylinder 65 is actuated to bring down the movable block 63, so that the insulation displacement tooth 43 and crimper 44 fitted to the movable block 63 force down the ends of wires (not shown) to insert them into the connector, and thus the insulation displacement terminals are secured to the wires in the manner as previously described. Thereafter, the air cylinder is further actuated to bring the cutter 75 to drop onto the groove 81 to out off the linking piece 17 of the socket housing 13. Once in this way the attachment of wires is completed, the connector aggregate 11 is again delivered by the pusher 80, and the connector to which the attachment of wires has been completed drops from the chute 82.

The connector aggregate 11 can also employ crimp terminals as the terminals. In general, the crimp terminals are handled in such a way that terminals are secured to the ends of wires using a crimping machine and thereafter the resulting terminals are fitted to a socket housing. However, taking the structure as illustrated in FIG. 8 makes it possible to attach wires in the state that the crimp terminals are previously received in the socket housing.

More specifically, a crimp terminal 91 comprises a female contact 93 formed by folding both sides of the front end of a bottom wall 92, a pair of wire stripped portion holding claws 94 formed by folding both sides of the middle portion of the bottom wall 92 into a U-form, and a pair of wire unstripped portion holding claws 95 formed by folding both sides of the rear end of the bottom wall 92. A hook 96 like that of the insulation displacement terminal 21 described above is also provided in the bottom wall 92 at a portion near to the front. Then the crimp terminal 91 is inserted into the socket housing 13, so that the hook 96 is engaged with the bottom opening 19 of the socket housing 13 to prevent dislocation. Also, an opening 20 through which an anvil 101 to crimp the stripped portion holding claws 94 is inserted is provided at the bottom of the socket housing 13. The numeral 102 denotes a crimper to crimp the stripped portion holding claws 94; 103, an anvil to crimp the unstripped portion holding claws 95; and 104, a crimper to crimp the unstripped portion holding claws 95.

A wire 31 is so stripped at its end with a given length that a core 33 may be exposed to give a stripped portion. Then the stripped portion corresponding to the exposed core 33 and the unstripped portion provided with a cover 32 are disposed at their corresponding upper sites so that they may be inserted between the stripped portion holding claws 94 and the unstripped portion holding claws 95, respectively. With this state, the anvils 101 and 103 are brought up and the crimpers 102 and 104 are brought down. The anvil 101 go through the opening 20 to come into collision with the bottom wall 92 of the crimp terminal 91, and the anvil 103 comes into collision with the bottom of the socket housing 13. Also, the crimpers 102 and 104 force down the wire 31 to dispose the wire 31 as shown by imaginary lines in FIG. 8, and the crimper 102 inward crimps the stripped portion holding claws 94 in a synchronous motion with the anvil 101 to hold the stripped portion 33. The crimper 104 inward crimps the unstripped portion holding claws 95 in a synchronous motion with the anvil 103 to hold the unstripped portion of the wire 31.

Figure 8:
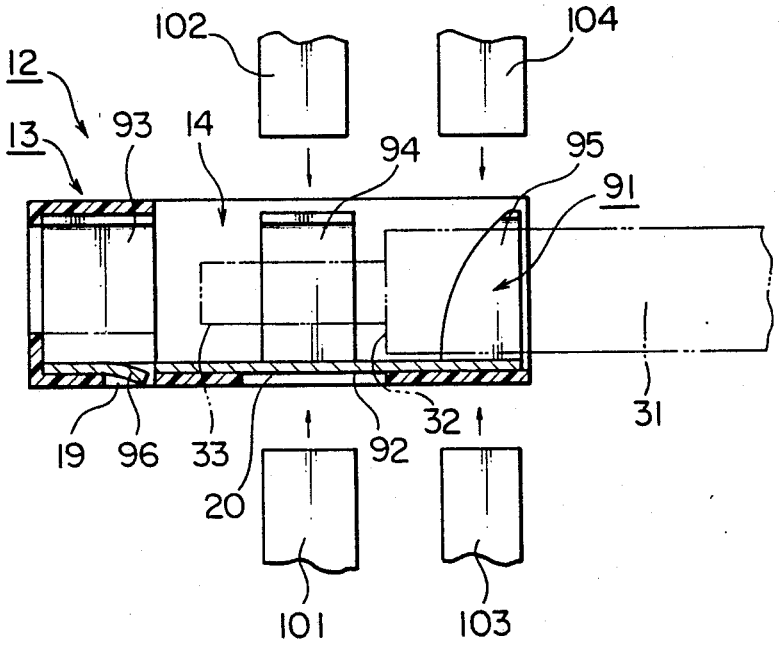
FIG. 8 is a cross section of a crimp connector used in another embodiment in which the present invention has been applied.

It is therefore possible also in the crimp connectors to apply the same wire processing method as in the insulation displacement connectors, by composing the connector aggregate 11 with use of the connector 12 as illustrated in FIG. 8.

As described in the above, the present invention comprises connectors being linked in a belt-like fashion through linking pieces provided on both side portions of a socket housing, and hence the connectors can be fed to a wire processing apparatus with a simplified structure, so that it becomes unnecessary for the apparatus to be provided with accessory units such as an expensive parts feeder, and also the production cost of the wire processing apparatus can be reduced. Also, since the connectors can be precisely arranged in line owing to the linking pieces, the rate of the reject parts production due to wire misattachment can be decreased. In addition, even if the size of the connectors to be used has been modified, simple parts such as guides adjacent to the wire processing apparatus need only be changed, resulting in improved operability. Also, if the connectors linked in a belt-like fashion are wound on a reel, they can be better handled in the manufacture and feeding of the connectors. Moreover, the connector aggregate of the present invention can be applied to both insulation displacement connectors and crimp connectors.

What is claimed is:

1. A connector aggregate, comprising: a plurality of connectors, each connector comprising:

a socket housing having a plurality of connecting sections; and a plurality of terminals corresponding in number to the number of connecting sections, a respective terminal being mounted in each connecting section; and linking members for linking said connectors together in a belt-like fashion, said linking members being provided on opposite side portions of each of said socket housings and being readily separable to separate said linked connectors from each other;

said terminals comprising insulation displacement terminals mounted in said respective connecting sections prior to connection of a wire thereto, whereby respective wires are directly connectable to said insulation displacement terminals while said terminals are mounted in said connecting sections and while said connectors are connected together via said linking members.

2. The connector aggregate according to claim 1, wherein said connectors linked in a belt-like fashion are wound on a reel.

3. The connector aggregate according to claim 1, wherein said linking members are integrally formed with said connectors by molding.

4. A method of attaching a wire to a connector forming part of said connector aggregate according to claim 1, comprising:

feeding said connector aggregate in which each connector is in said linked state, to an apparatus for attaching ends of wires to said terminals mounted in said connecting sections of said connectors;

forcing down ends of said wires to secure them to corresponding terminals of said connector of said connector aggregate; and thereafter cutting off said linking member between a pair of adjacent connectors to separate at least one of said connectors into an individual connector.

5. A connector aggregate, comprising:

a plurality of connectors, each connector comprising:

a socket housing having a plurality of connecting sections; and a plurality of terminals corresponding in number to the number of connecting sections, a respective terminal being mounted in each connecting section; and linking members for linking said connectors together in a belt-like fashion, said linking members being provided on opposite side portions of each of said socket housings and being readily separable to separate said linked connectors from each other;

said terminals comprising crimp terminals mounted in said respective connecting sections prior to connection of a wire thereto, whereby respective wires are directly connectable to said crimp terminals while said terminals are mounted in said connecting sections and while said connectors are connected together via said linking members.

6. The connector aggregate according to claim 5, wherein said connectors linked in a belt-like fashion are wound on a reel.

7. The connector aggregate according to claim 5, wherein said linking members are integrally formed with said connectors by molding.

8. A method of attaching a wire to a connector forming part of said connector aggregate according to claim 5, comprising:

feeding said connector aggregate in which each connector is in said linked state, to an apparatus for attaching ends of wires to said terminals mounted in said connecting sections of said connectors;

forcing down ends of said wires to secure them to corresponding terminals of said connector of said connector aggregate; and thereafter cutting off said linking member between a pair of adjacent connectors to separate at least one of said connectors into an individual connector.

9. The connector aggregate according to claim 5, wherein:

said crimp terminals mounted in said connecting sections of said socket housing each comprise a contact, at least a pair of first claws for holding a stripped portion of a wire, and at least a pair of second claws for holding an unstripped portion of the wire; and said socket housing further comprises:

a first opening at a front end face thereof through which said contact is received;

a second opening at a top thereof and through which a wire is insertable and through which crimpers to crimp said first claws and said second claws are insertable; and a third opening at a bottom thereof and through which an anvil used for crimping said first claws is insertable.

10. The connector aggregate according to claim 9, wherein said connectors linked in a belt-like fashion are wound on a reel.

11. The connector aggregate according to claim 9, wherein said linking members are integrally formed with said connectors by molding.

* * * * *